US007138906B2

(12) United States Patent
Rosche

(10) Patent No.: US 7,138,906 B2
(45) Date of Patent: Nov. 21, 2006

(54) CAP TIMING

(75) Inventor: Roger M. Rosche, Singapore (SG)

(73) Assignee: Remind Cap Pte. Ltd., Singapore (SG)

( * ) Notice: Subject to any disclaimer, the term of this patent is extended or adjusted under 35 U.S.C. 154(b) by 224 days.

(21) Appl. No.: 11/009,184

(22) Filed: Dec. 10, 2004

(65) Prior Publication Data

US 2006/0139151 A1 Jun. 29, 2006

(51) Int. Cl.
*G08B 1/00* (2006.01)

(52) U.S. Cl. ..... 340/309.16; 340/309.7; 368/244; 215/200

(58) Field of Classification Search ..... 340/309.16
See application file for complete search history.

(56) References Cited

U.S. PATENT DOCUMENTS 6,084,504 A * 7/2000 Rosche et al. ..... 340/309.7
6,633,796 B1 * 10/2003 Pool et al. ..... 700/231
6,765,478 B1 * 7/2004 Zhurin ..... 340/309.16
2002/0093427 A1 * 7/2002 Roth et al. ..... 340/573.1
2006/0022806 A1 * 2/2006 Auerbach ..... 340/309.16

* cited by examiner

*Primary Examiner*—Daniel Wu
*Assistant Examiner*—George A. Bugg
(74) *Attorney, Agent, or Firm*—Fish & Richardson P.C.

(57) ABSTRACT

A cap is attachable to a receptacle for co-acting therewithin enclosing medication and timing a predetermined interval for taking the medication defined by one timing schedule of a set of selectable timing schedules. An electronic timing circuit in the cap is constructed and arranged to provide an alarm signal designating a time for taking the medication at the expiration of a predetermined time interval defined by the timing schedule. A battery furnishes power to the electronic timing circuit. A switch is connected between the battery and the electronic timing circuit having an initial ship position preventing the flow of electrical energy from the battery to the electronic timing circuit and an on position allowing delivery of electrical power from the battery to the electronic timing circuit. The switch is constructed and arranged to be initially in the ship position and switch to the on position when the cap is first attached to the receptacle to close the receptacle.

5 Claims, 13 Drawing Sheets

CAP TIMING

The present invention relates in general to cap timing and more particularly concerns apparatus and techniques related to a cap that is attachable to a receptacle for timing a predetermined interval according to a timing schedule of a set of timing schedules to provide a sensible alarm signal at the expiration of the predetermined time interval.

BACKGROUND OF THE INVENTION

For background reference is made to U.S. Pat. Nos. 5,016,230 and 6,084,504 incorporated herein by reference.

SUMMARY OF THE INVENTION

One aspect of the invention is an improved device that is attachable to a receptacle for timing a predetermined interval according to a timing schedule of a set of timing schedules. The device has an electronic timing circuit that provides an alarm signal at the expiration of the predetermined time interval. The timing circuit includes a set of inputs and a set of outputs that are both connected to processing circuitry. The inputs correspond to the timing schedules and the outputs issue the alarm signals.

Embodiments of this aspect of the invention include one or more of the following features.

A selector mechanism allows the timing schedule to be mechanically selected.

The details of one or more embodiments of the invention are set forth in the accompanying drawings and the description below. Other features, objects and advantages of the invention will be apparent from the following detailed description and when read in connection with the accompanying drawings in which:

BRIEF DESCRIPTION OF SEVERAL VIEWS OF DRAWINGS

Figure 2:
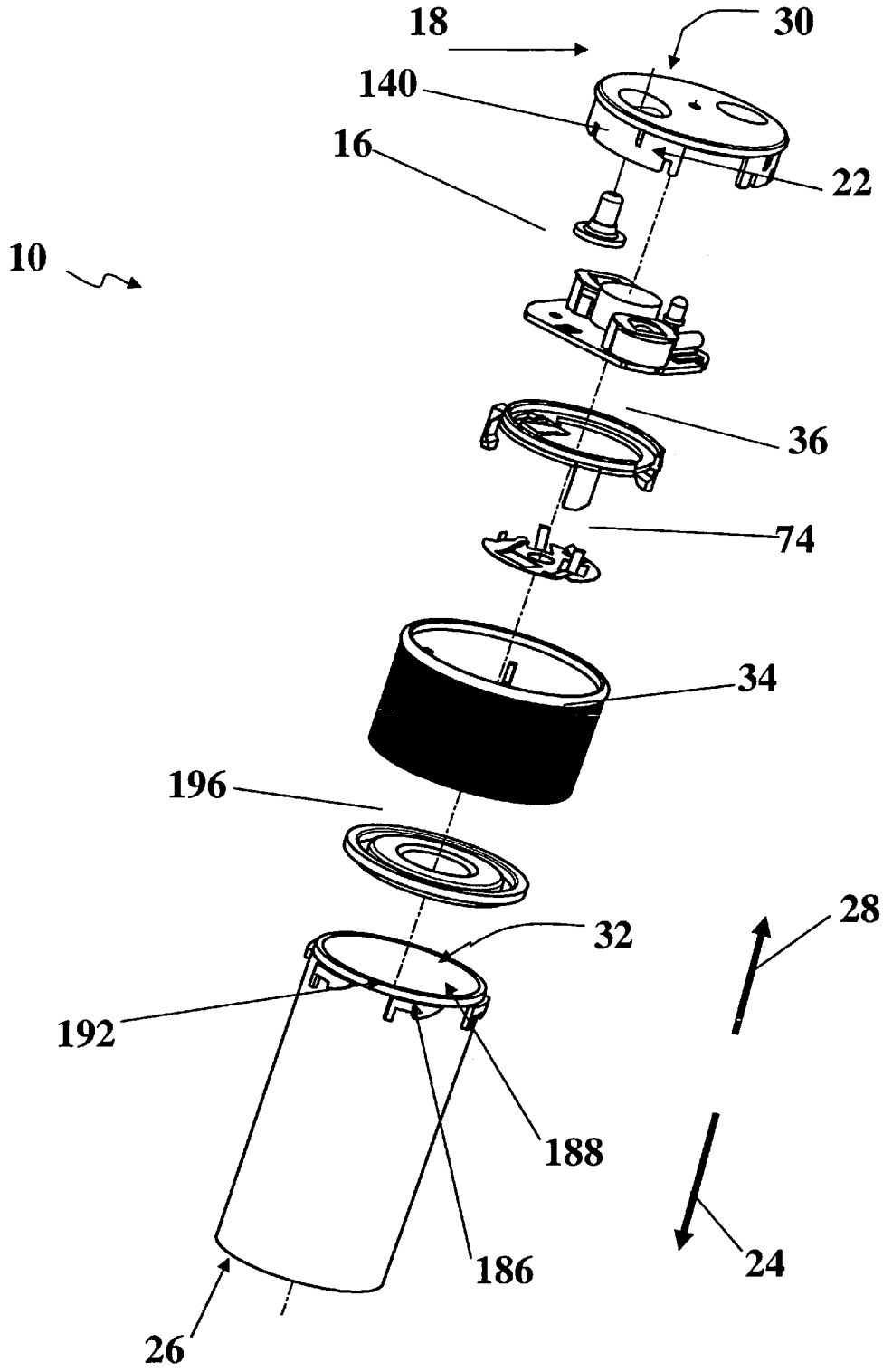
FIG. 2 is an exploded perspective view of the container of FIG. 1 along a longitudinal axis extending through the cap and the container.
Figure 3A:
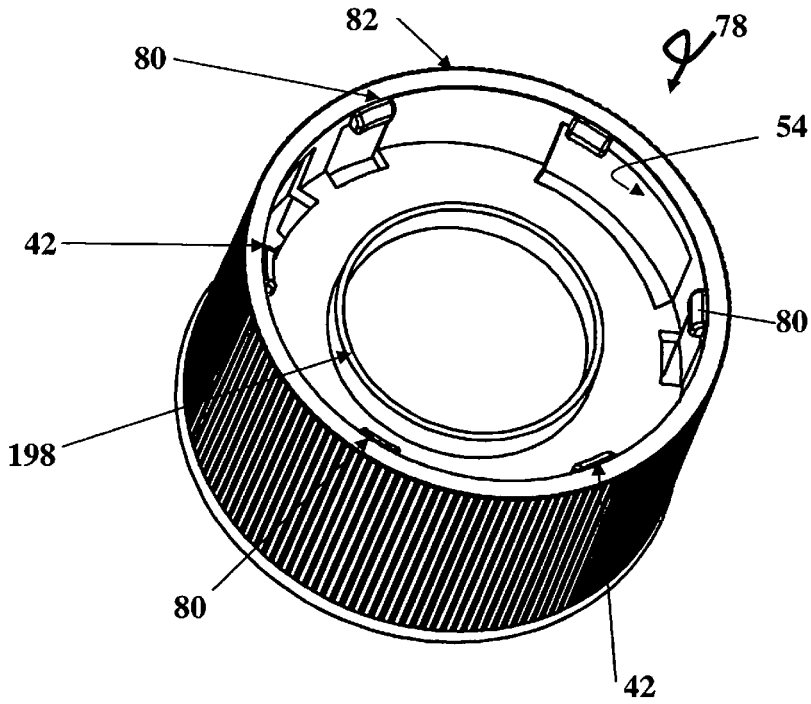
Figure 3B:
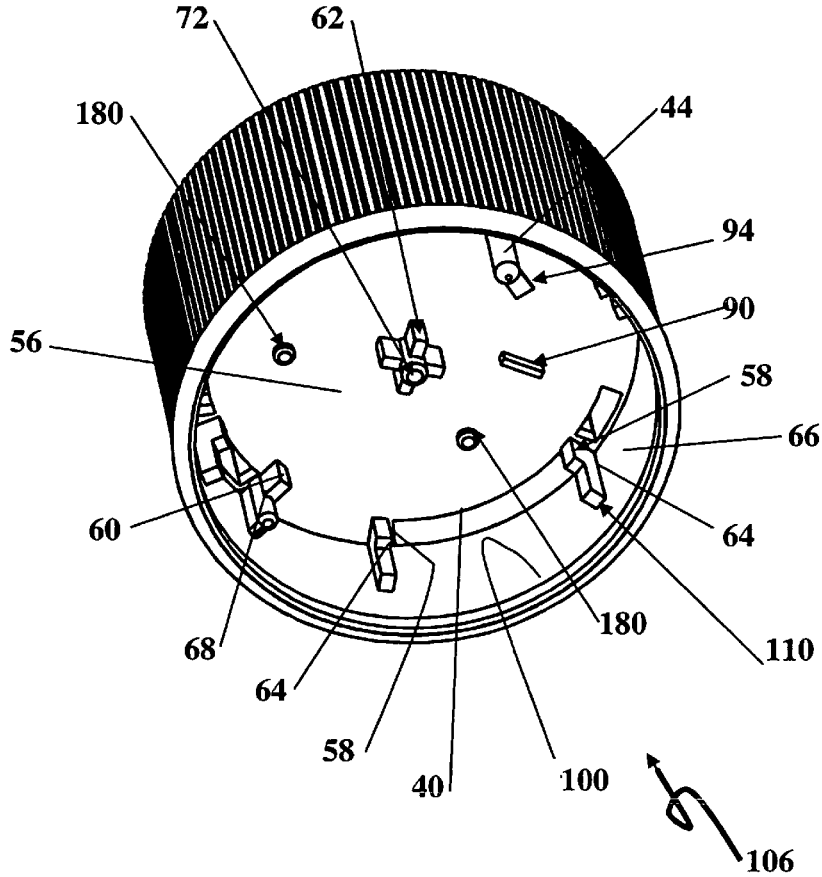
Figure 4A:
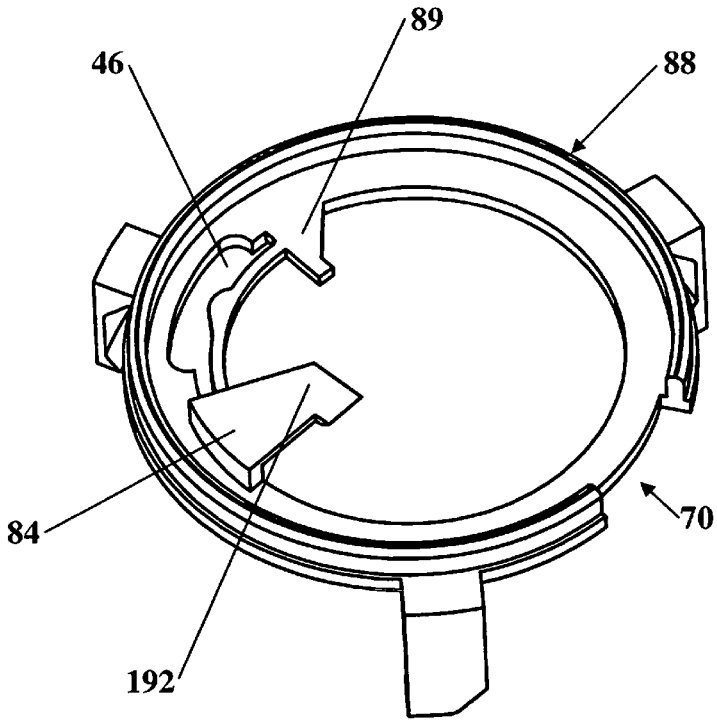
Figure 4B:
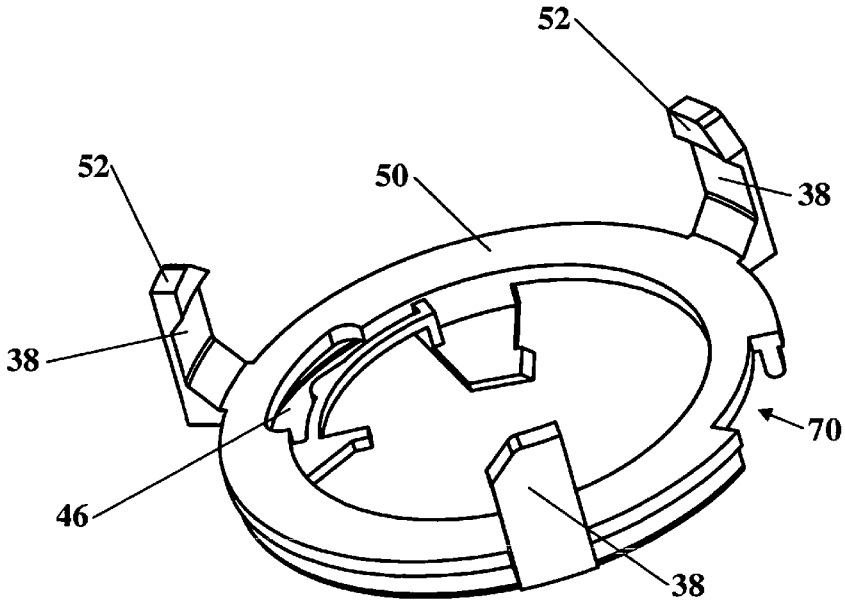
Figure 5:
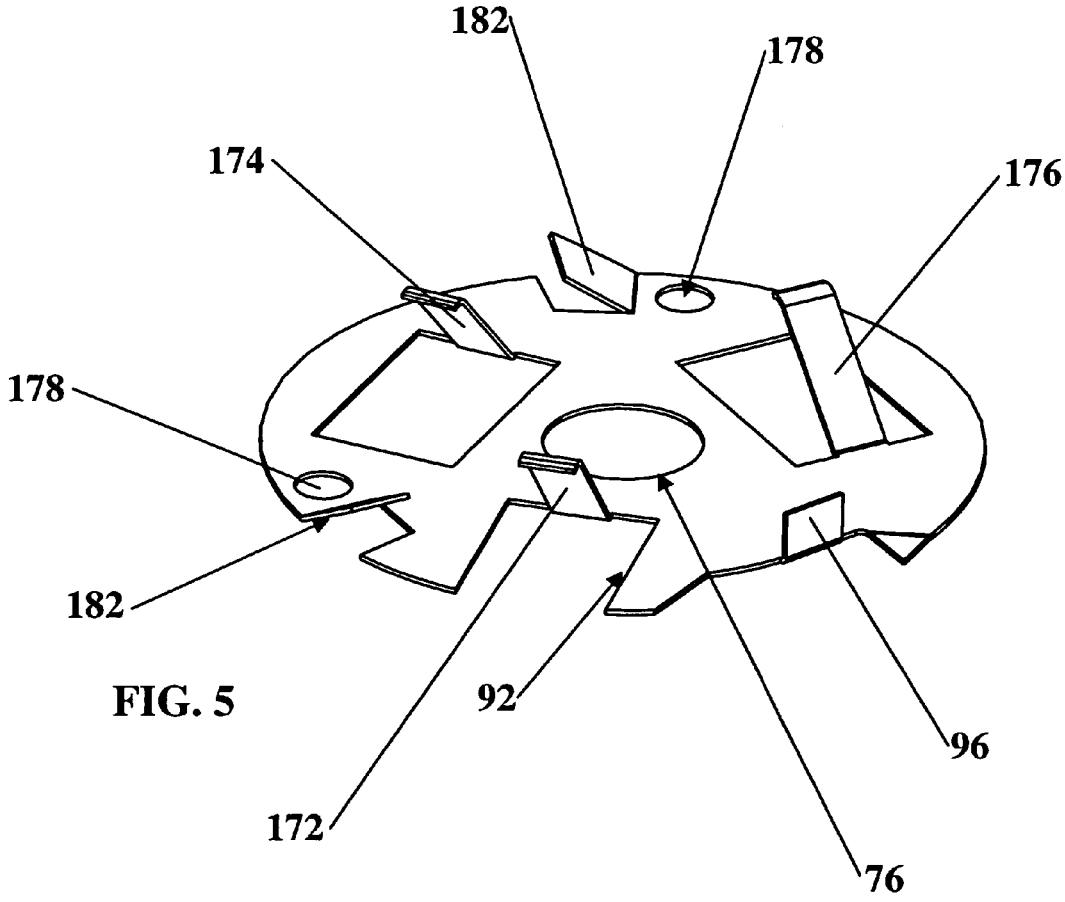
Figure 6A:
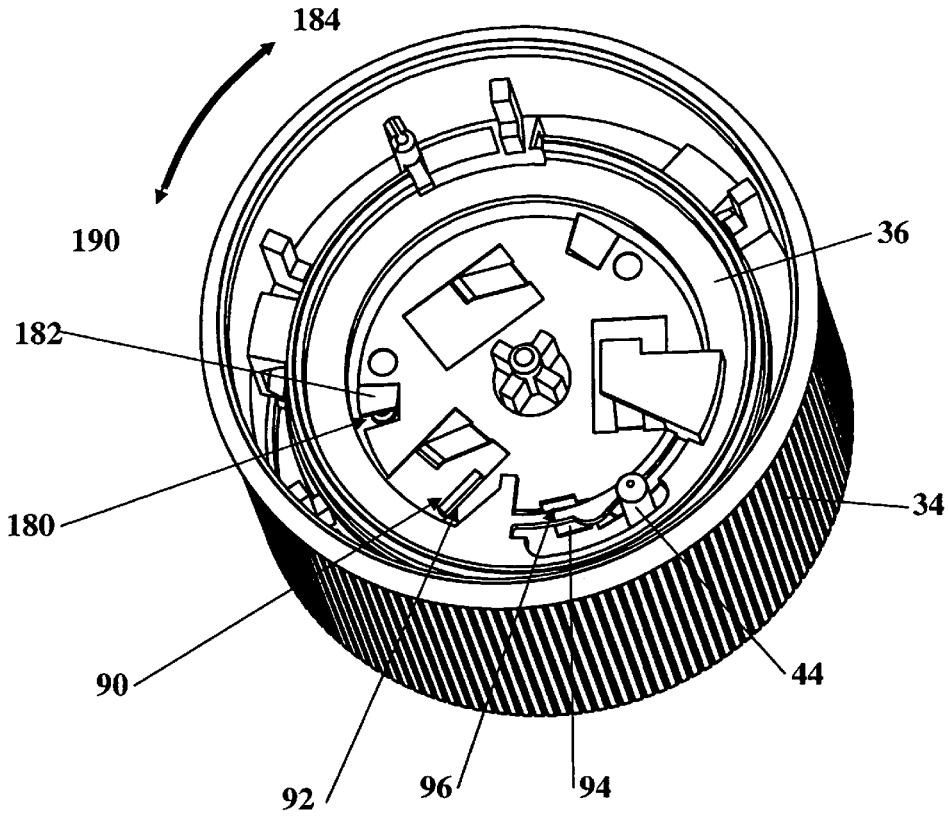
Figure 6B:
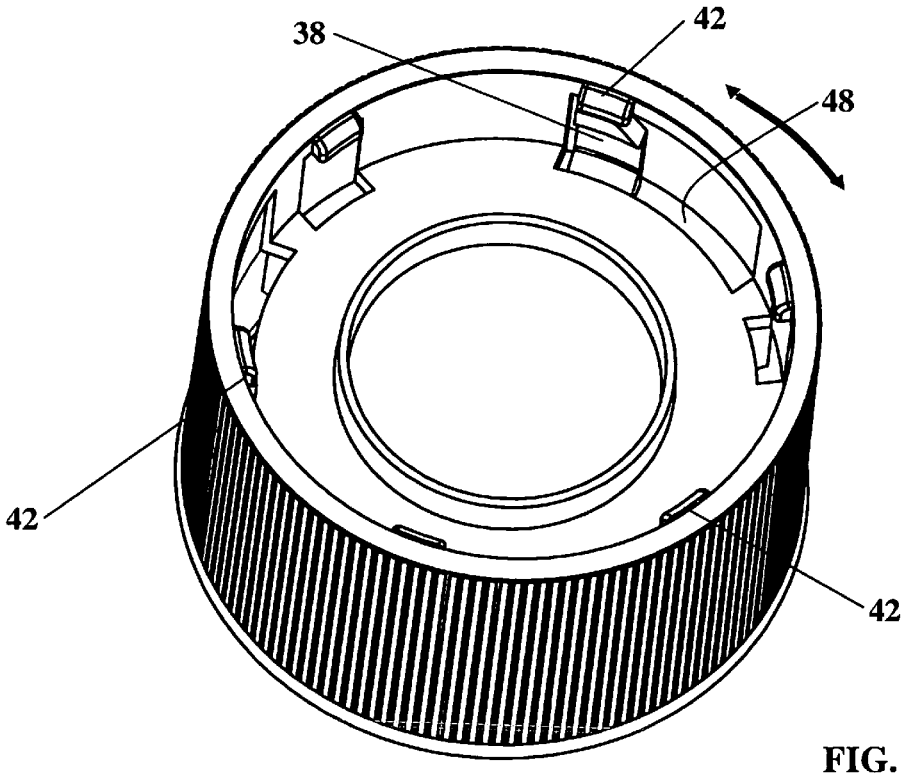

FIG. 3*a* is a perspective view of the bottom side of the housing of the container of FIG. 2 showing a posterior side of the housing;

FIG. 3*b* is a perspective view of the inner topside of the housing of the container of FIG. 2;

FIGS. 4*a* and 4*b* are a perspective view, of the topside and bottom side, respectively, of the trigger of the container of FIG. 2;

FIG. 5 is a perspective view of the spring plate contact of the container of FIG. 2;

FIG. 6*a* is a perspective view of the inner topside of the housing assembled with the spring plate contact and the trigger of FIG. 4*a* positioned in a ship position;

FIG. 6*b* is a perspective bottom view of the housing of the inner topside with trigger in the same position as FIG. 6*a;*

Figure 1:
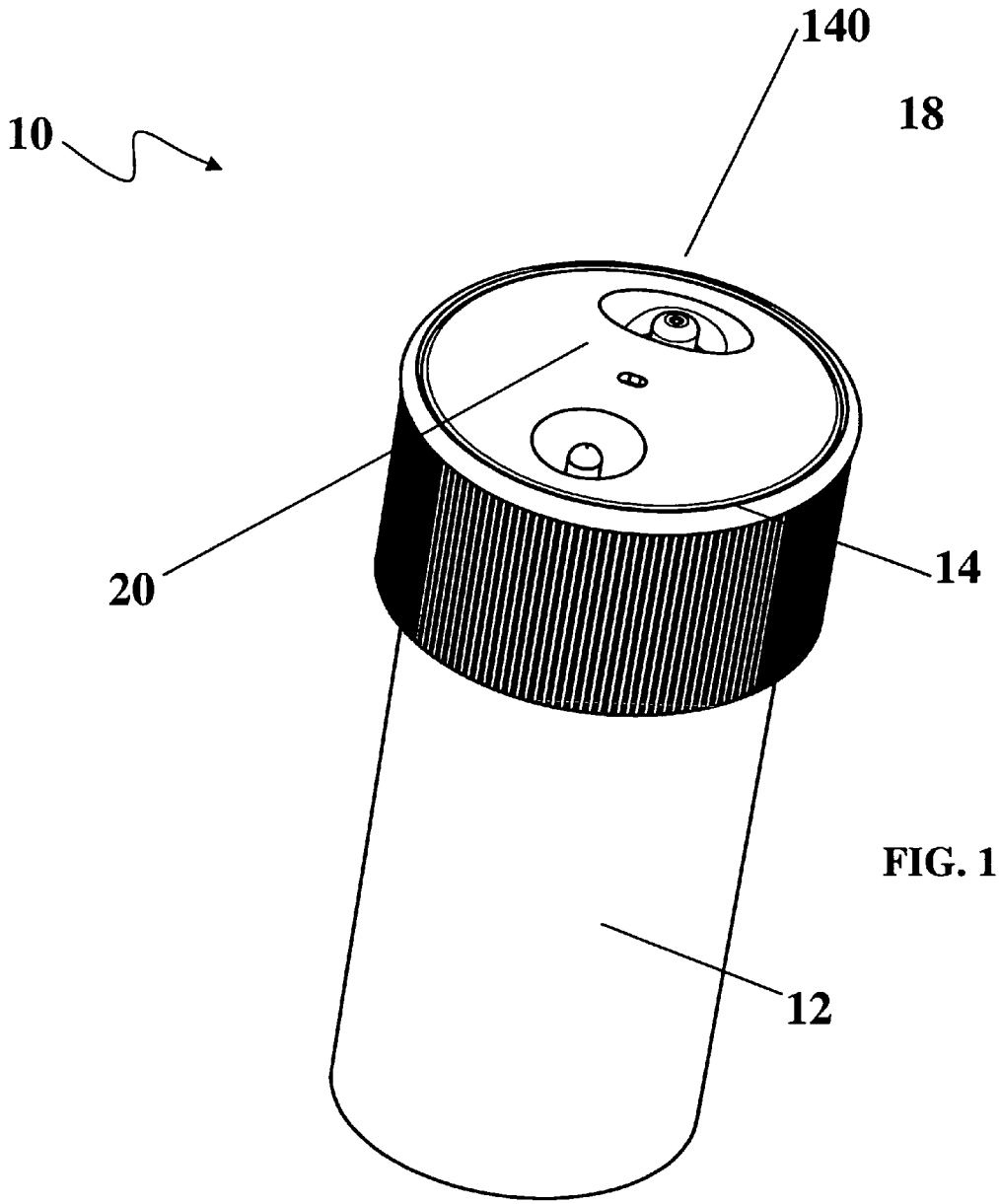
FIG. 1 is a perspective view of a medication container having a cap according to the invention, attached to a receptacle.
Figure 7A:
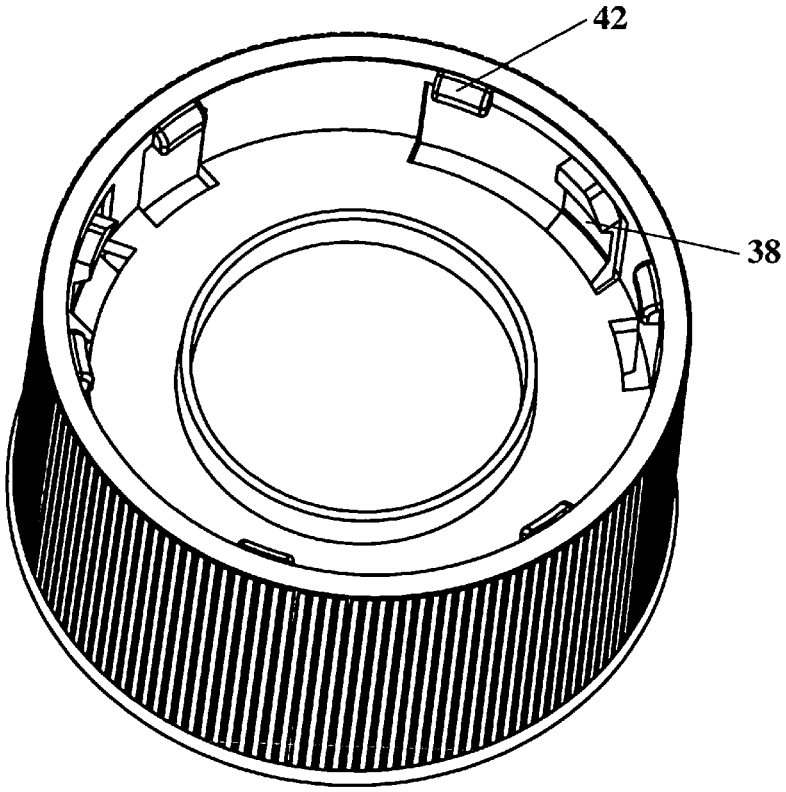
Figure 7B:
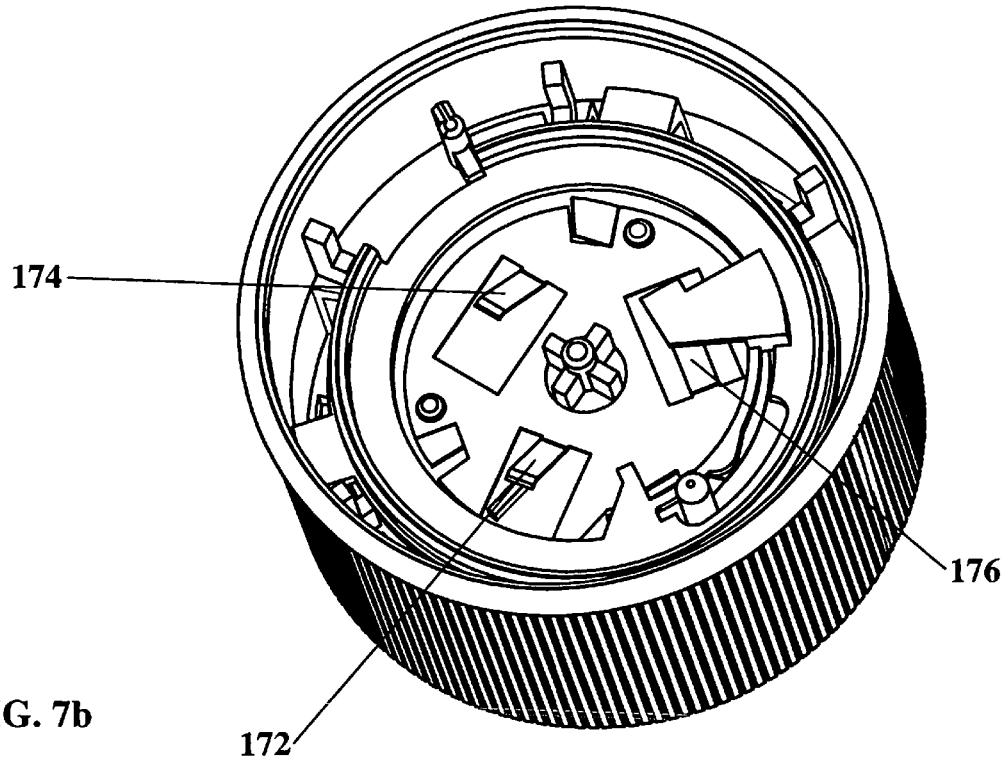
Figure 8:
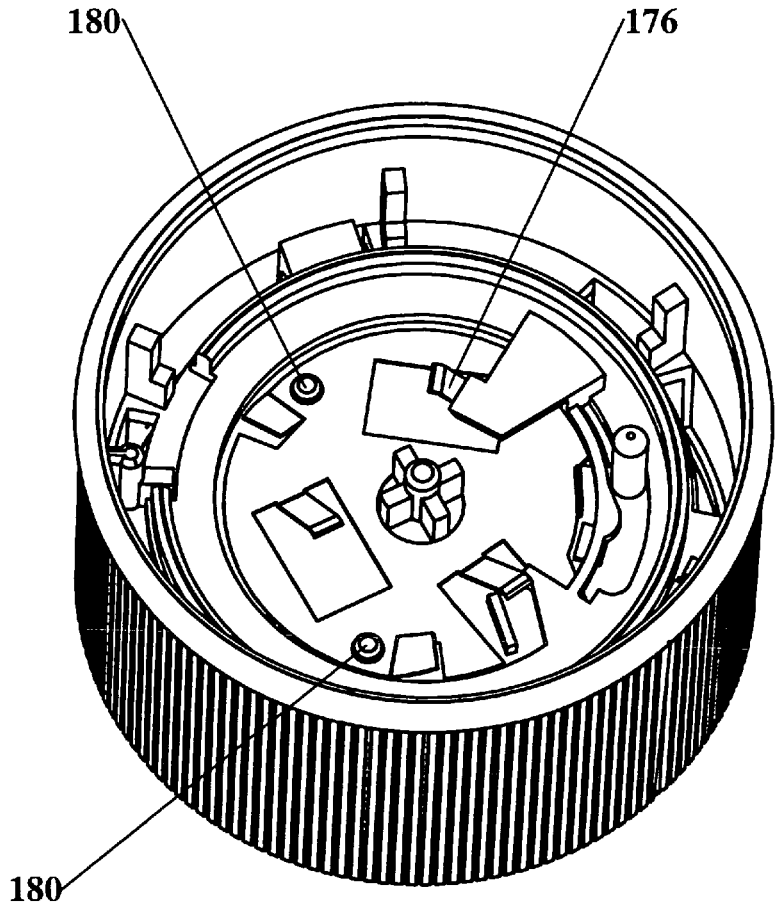
Figure 9A:
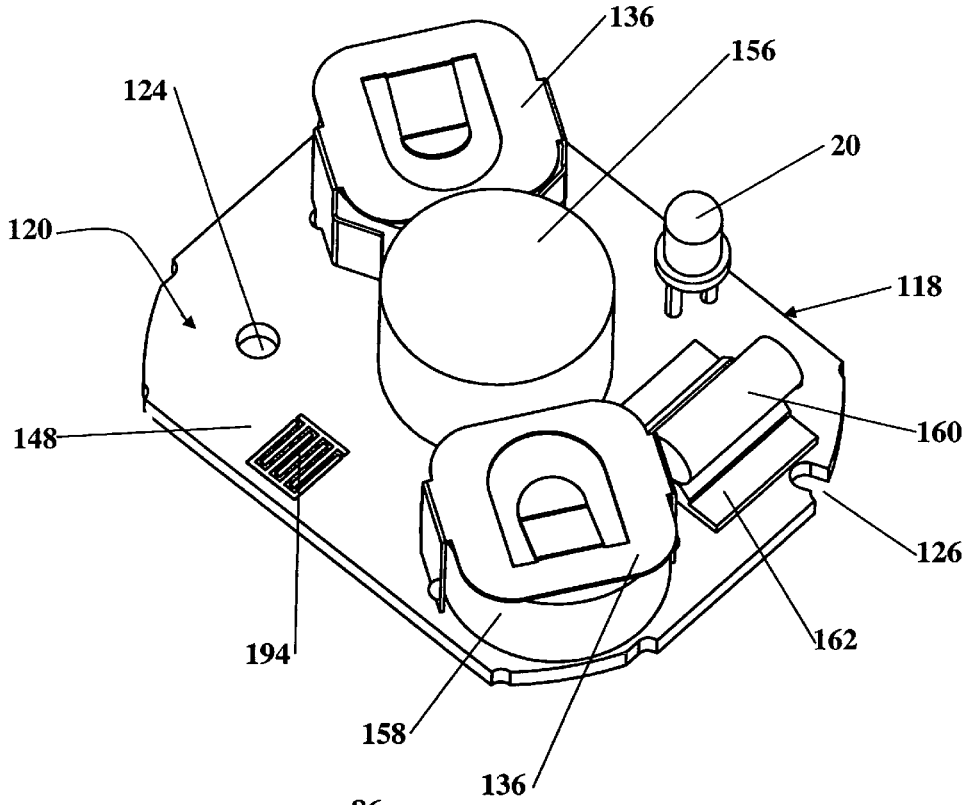
Figure 9B:
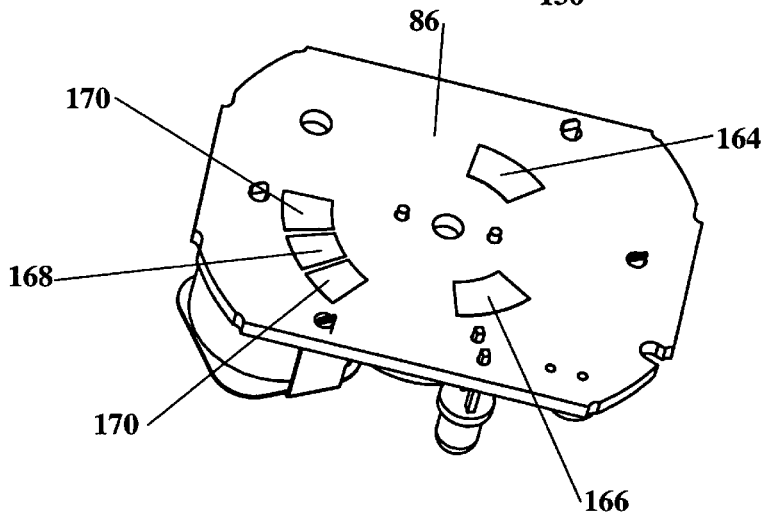

FIG. 7*a* is a perspective bottom view of the housing assembled with the trigger of FIG. 4*a* positioned in a close position;

FIG. 7*b* is a perspective inner top view of the housing with trigger and spring plate contact in a close position;

FIG. 8 is a perspective inner top view of the housing with trigger and spring plate contact in an activated open position;

FIG. 9*a* is perspective view of the anterior side of the timing device of the cap of FIG. 1;

FIG. 9*b* is a perspective view of the posterior side of the timing device of FIG. 9*a;*

Figure 10:
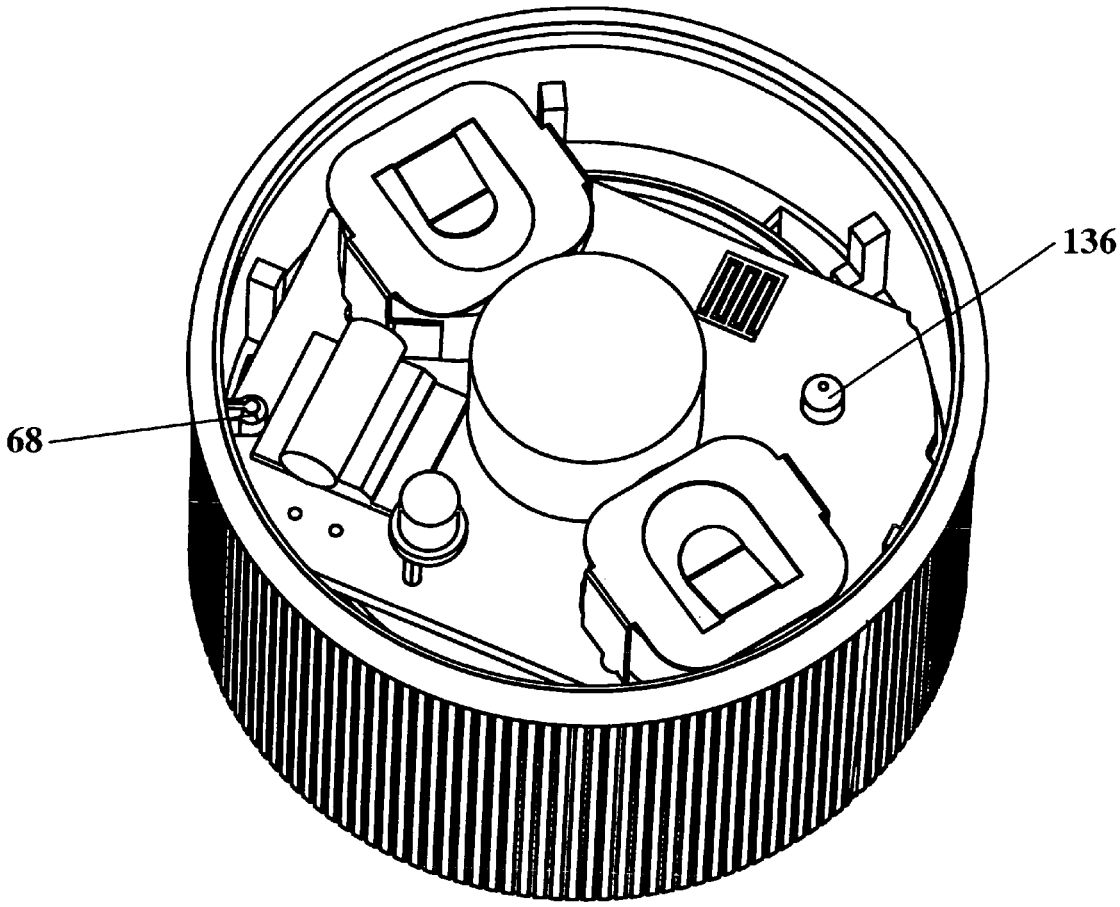

FIG. 10 is a perspective inner top view of the housing with timing device of FIG. 5*a;*

Figure 11A:
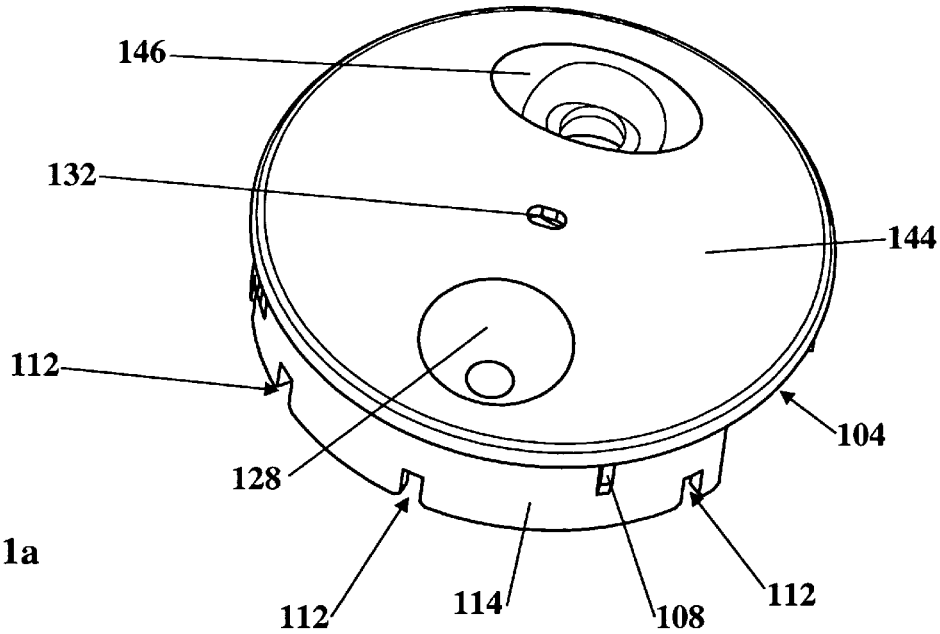

FIG. 11*a* is a perspective top view of the top part of FIG. 1*a*

Figure 11B:
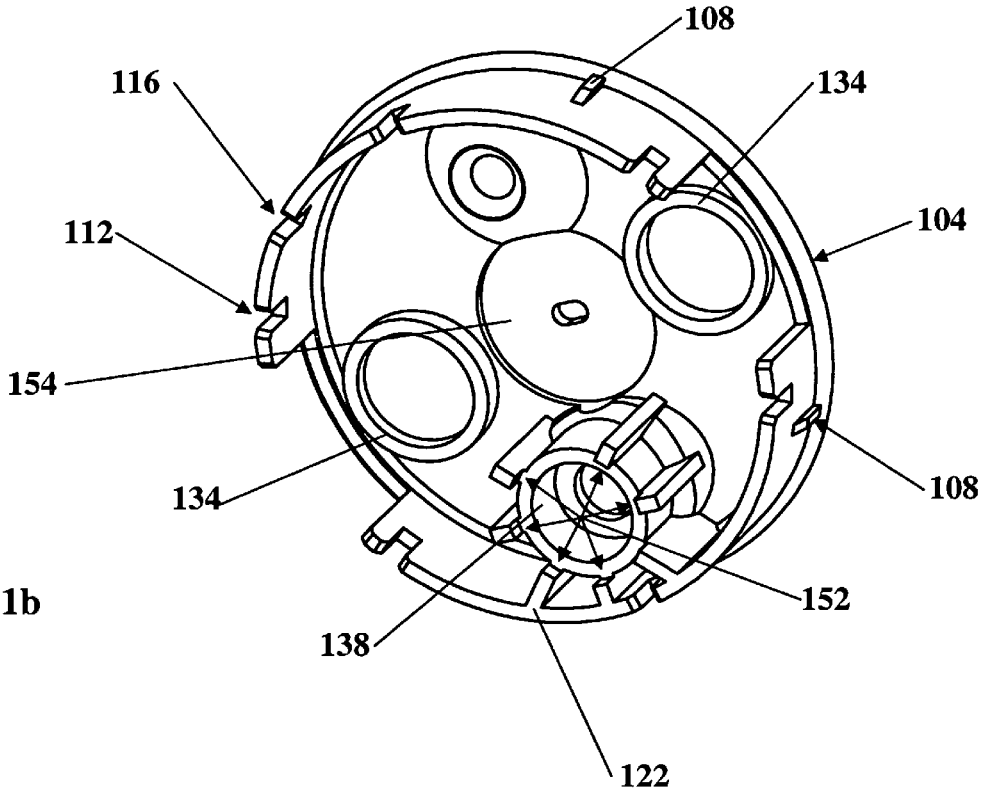

FIG. 11*b* is a perspective bottom view of the top part of FIG. 1*a;*

Figure 12:
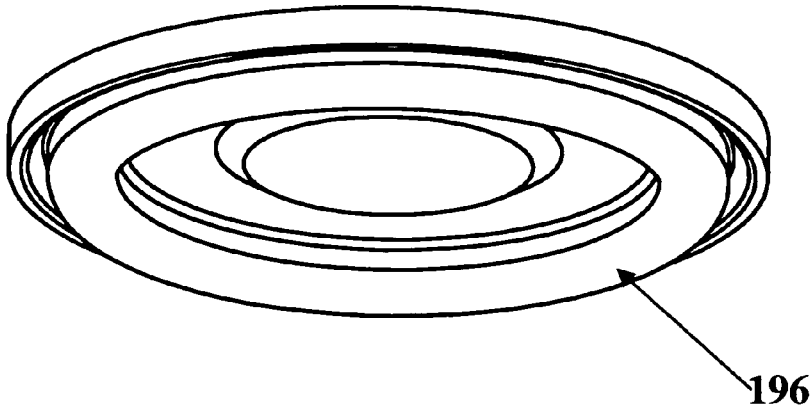
Figure 13:
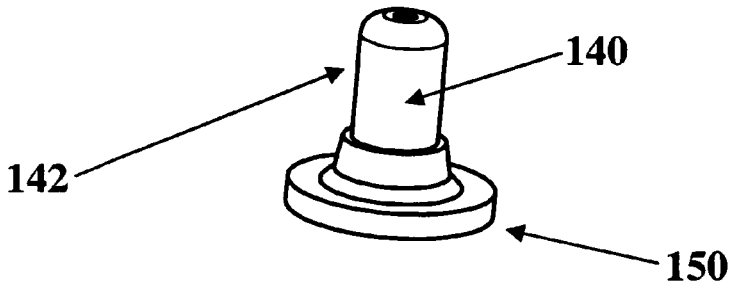
Figure 14:
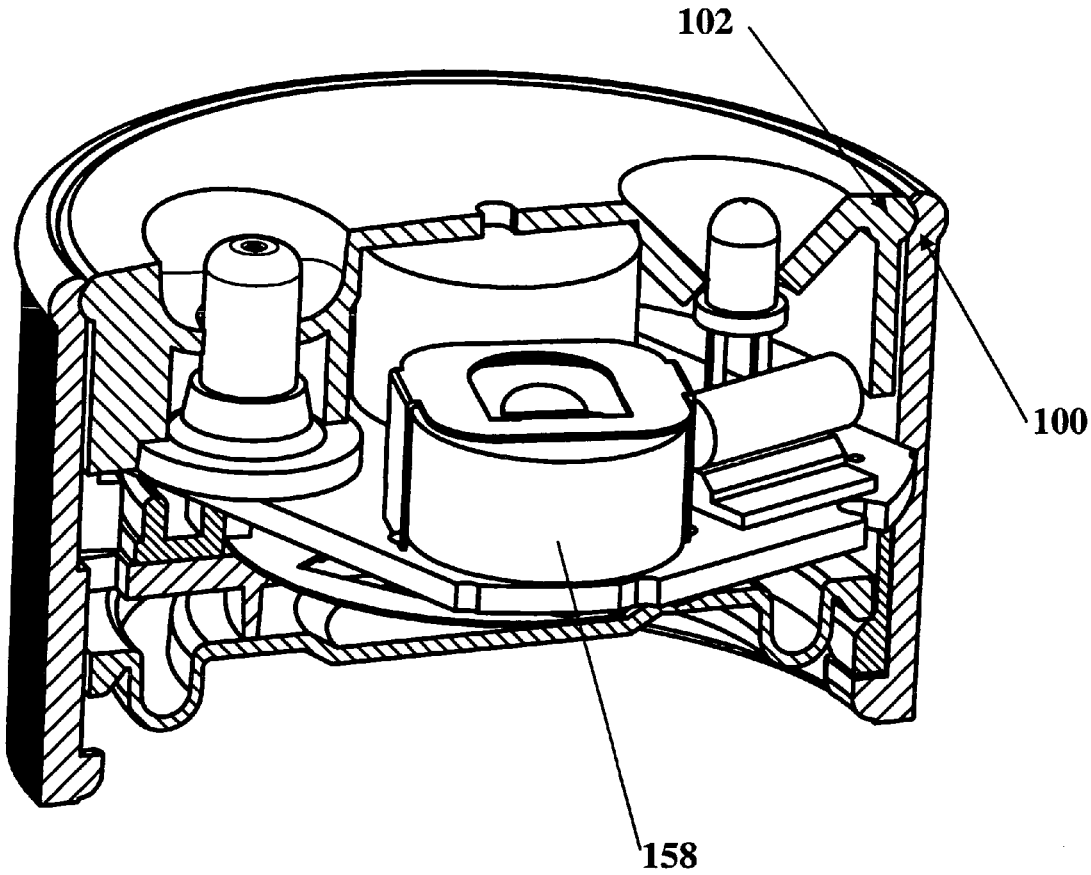

FIG. 12 is a perspective view of the seal of the container of FIG. 2;

FIG. 13 is a perspective view of the reset button of the container of FIG. 2; and FIG. 14 is a perspective view partially in cross section of the plastic parts of the complete cap, across the line over the LED and the reset button showing the interrelation of both mechanical and electrical components of the cap.

DETAILED DESCRIPTION

Referring to FIG. 1 a medication container 10 includes a receptacle 12 suitable for containing medication and a cap 14 that includes a timing device 16 (FIG. 2) to provide an alarm signal according to a predetermined schedule that indicates the appropriate time to administer the medication. Based on a prescription, pharmacists can deliver caps 14 with different time and duration schedules. The electronic IC on the electronic device 16 is programmed with different schedules. Top part 18 carries the printed timing and duration schedule of cap 14.

When medication container 10 activates the alarm signals, which may be a combination of a repetitive "beeping" sound and flashing LED 20, a user opens medication container 10 by removing cap 14 from receptacle 12 to access the medication. At that time, medication container 10 senses that cap 14 was removed and resets the alarm after a predefined interval expires.

Referring also to FIG. 2, medication container 10 is roughly cylindrical about a longitudinal axis 22. To provide a reference for the structure of medication container 10 relative to longitudinal axis 22, receptacle 12 extends in a posterior direction 24 of container end 26 of medication container 10. Similarly, cap 14 extends in an anterior direction 28 and is located near an anterior end 30 of medication container 10. Receptacle 12 is a hollow cylindrical member having a single opening 32 at an end nearest anterior end 30. Cap 14 attaches over opening 32 to enclose the hollow space of receptacle 12.

In addition to timing device 16, cap 14 includes a trigger 36, a housing 34 and top part 18. Referring to FIGS. 2, 4*a* and 4*b*, trigger 36 is, typically a plastic (e.g. polypropylene) washer with several "legs" 38, which activate or deactivate timing device 16. Trigger 36 is sized to fit in cap 14 (FIG. 6*a*). Tabs 38 (FIG. 4*b*) of trigger 36 fit in the sleeves 40 (FIG. 3*b*) of housing 34 and are positioned above grips 42 (FIG. 3*a*) in housing 34 (see FIG. 6*b*) at the nearest posterior side 26 of housing 34. Sleeves 40 are formed in the surface 56 in housing 34 (FIG. 3*b*). Each of tabs 38 is perpendicular to ring section 50 and extends in posterior direction 24. Each tab 38 has a lip 52 located near posterior end 26. The number of tabs 38 is typically half of the number of grips 42 of housing 34. For a proper orientation of trigger 36 in housing 34, an alignment pin 44 in housing 34 guides and positions its sleeve 46 (FIG. 4*a*) of trigger 36. Trigger 36 can rotate freely through a fixed angle 48. When trigger 36 rotates inside housing 34, tabs 38 move in reset areas 54 in the near posterior ends 24 of housing 34 (FIG. 3*a*). Trigger 36 also has a ramp 84, parallel to the ring section 50, mounted in the anterior direction 28. (FIG. 4*a*) When cap 14 is assembled with trigger 36 inside, ramp 84 of trigger 36 is just free of the board section surface 86 of the electronic device 16. By rotational movement of trigger 36, ramp 84 can freely move beneath the board section surface 86. The ridge 88 at the anterior of ring section 50 functions as a spacer to board surface 86. Cap 14 in assembled position locates trigger 36 between board surface 86 and surface 56. Trigger 36, e.g., typically 35 mm in diameter by 11 mm in height is typically made of polypropylene. The trigger 36 also has a second ramp 89. This ramp 89 is at the anterior of ring 50 at the same level. The posterior side of ramp 89 is typically 0.3 mm thinner than the ring section surface 50. The cap 14 in assembled position locates spring plate contact 74 in a free space to trigger 36 at ramp 89 so that trigger 36 can rotate freely inside cap 14.

Housing 34, typically 39 mm in diameter by 24 mm in height, is typically made of polypropylene. FIG. 3*b* shows spacers 58 at the side of ground surface 56 inside housing 34. Spacers 58 are positioned directly to spacing posts 64, beside inner wall 66 of the housing 34. Spacer 60 is connected to alignment pin 68. Spacer 60 is longer than spacers 58 so that the assembly of trigger 36 includes a notch 70 is the periphery of ring section 50. (FIG. 4*b*) Notch 70 moves beside spacer 60 when cap 14 is assembled and trigger 36 inserted into housing 34 so that sleeve 46 moves freely across alignment pin 44 of housing 34. Alignment pins 68 and 44 extend together in anterior direction 28. Trigger 36 can rotate because tabs 38 of trigger 36 are guided in sleeves 40 of housing 34. Spacers 62 in the center of surface 56 are located to the center pin 72. Spacers 62 together are guided by spring plate contact 74 in middle hole 76 (FIG. 5). Spacers 58, 60 and 62 are positioned about housing 34 to provide space that accommodates portions of electronic devices 16, which rests on spacers 58, 60 and 62.

Referring to FIGS. 2, 3*a* and 3*b*, housing 34 includes a mechanism to secure cap 14 in a closed position, and in combination with trigger 36, comprises a mechanism to activate or deactivate alarm signals provided by timing device 16. Housing 34 is typically generally cylindrical and has an opening 78 oriented toward receptacle 12.

Housing 34 includes grips 42 and 80 disposed along a lower peripheral edge 82. Grips 42 and 80 secure cap 14 to receptacle 12 and are spaced equidistantly about peripheral edge 82 as shown 3*a*. Several position and align shapes are mounted in surface 56 of housing 34 to properly position spring plate contact 74. An alignment ridge 90 positions spring plate contact 74 properly along edge line 92 (FIG. 5) anterior inside 106 of housing 36. A second alignment shape in surface 56 of housing 34 is a small rectangular profile 94. During the assembly of cap 14 ramp 96 of spring plate contact 74 is preferably located to be visible opposite this profile 94 on surface 56. A groove 100 is located inside housing 34 at the anterior side to position top part 18 for closing the complete cap 14. FIG. 14 shows grove 100 hollow shaped. The top part 18 has a ball-shaped ridge 102 at the outer periphery edge line 104. During the complete assembly of cap 14, ball shape ridge 102 in top part 18 fits in the hollow-shaped groove 100 of housing 34. The entrance of the anterior side 106 of housing 34 is deformed slightly during assembly to ensure a good location of top part 18 in housing 34. Spacers 108 beside the outer wall 114 of top part 18 and in the posterior direction will give extra restriction for the fixation of the top part 18 inside the housing. The anterior end 110 of all the spacing posts 64 in the housing keeps the top part 18 in longitudinal position, to restrict movement inside in posterior direction 24. Top part 18 has notches 112, equally divided across the periphery wall 114 for these spacing posts 64 inside housing 34. An extra notch 116 fits alignment pin 68 in the housing 34 for radially positioning top part 18. Notch 116 is deeper in anterior direction than the other notches 112. In assembled position of cap 14, the outer periphery wall 114 of top part 18 keeps the board 118 of electronic timing device 16 in a fixed position. The posterior end surface 122 of periphery wall 114 presses directly on anterior surface 120 of board 118. Board 118 is longitudinally positioned with posterior side 86 to housing 34 and the anterior side 120 to the periphery wall surface 122 of top part 18, which has features for furnishing substantially equally divided pressure to components on board 118 of timing device 16. Two ring spacers 134 press battery holder 136 in its position on board 118. Extension 138 functions for silicon button 140 for the reset and start function of the electronic device 16 of cap 13. Silicon button 140 is fit in the top part 18 before definitive closing of cap 14 to allow assembly of cap 14 closing top part 18 into anterior side 106 in housing 34. Silicon button 140 has a long cylindrical shape 142 at the anterior side 28 that stabs front surface 144 at the anterior side of top part 18. An oval recess shape 146 is around this "button hole" in top part 18. The anterior side of this cylindrical shape 142 fits in oval recess 146 as shown in FIG. 14. Oval recess shape 146 is dimensioned so that a normal finger can compress this button 142 to 2 mm deep in posterior direction 24. There is carbon material in the posterior side of cylindrical shape 142. When cap 14 is fully assembled, by pressing the button 140 on the anterior side in posterior direction, this carbon material establishes a connection to a small contact surface 194 on board 118.

Silicon button 140 extends in the anterior direction into the extension 138 of top part 18. Cylindrical base part 150 of cylindrical button 140 fits lightly between extended ribs 152 of the extension 138 of top part 18. Full assembly of cap 14, automatically positions the cylindrical round shape 142 to board 118 as shown in FIG. 14.

The top part 18 includes anterior end opening 128 for accommodating LED 130 when cap 14 is assembled. End opening 80 is located of the end portion of top part 18 and is wider at an outer surface of top part 18 than at an inner surface of top part 18. Thus, opening 128 provides an outward-facing funnel-shaped depression that accommodates LED 20. This depression protects LED 20 from impact if, for example, medication container 10 is dropped. An audio port 132 is located in the center of top part 18. This opening 132 allows the audible alarm to be heard without excessive attenuation when cap 14 is fully assembled. A recess 154 is located at the posterior side of audio port 132 to fit the highest component of audio cell 156 of the electronic device 16.

Referring to FIGS. 2, 9*a* and 9*b*, timing device 16 comprises a timing circuit that produces an alarm signal according to a special timing schedule. When fully assembled, timing device 16 is adapted to fit into a relatively small volume between trigger 36 and housing 34. Timing device 16 includes a printed circuit board (PCB) 118 that functions as a structural support for electronic device 16 and provides conductive paths and electrical contacts 148 for the timing circuit. PCB 118 is typically 1.2 mm thick and fits in housing 34. To conserve space, electronic components of timing device 16 are mounted on the anterior side of PCB 118 and include two battery cells 158, which are connected to board 118 by two battery holders 136 to typically provide electrical potential, a cylindrical audio cell 156 to provide audio alarm signals, a timing crystal 160 to control clock pulse frequency, a integrated circuit chip (IC) 162 and some resistors and two capacitors.

The posterior side 86 of board 118 has three main contacts for a normal function of cap 14. Contact 164 is connected to IC 162 to switch the connection for open and close. Contact 166 is connected to the negative terminal of IC 162 and contact 168 is connected to the negative of the battery. These three contacts are used to activate the electronic circuit by contact 168 and to switch electronic device 16 between open and close of cap 14 of container 10. The other two contacts 170 beside contact 168 are not connected in the electronic circuit. Contacts 170 during the ship position of the spring plate contact 74 allow contact finger 172 to directly engage board surface 86.

The spring contact plate 74 has a ship position shown in FIG. 6*a*, at the anterior side 106 of housing 34 and is guided around spacers 62 in the center of surface 56. During rotation spring plate contact 74 moves beside ridge 90 to edge line 92 of spring plate contact 74. Contact fingers 172, 174 and 176 and ramp 96 are in the anterior position 28 of spring plate contact 74. Ramp 96 is opposite rectangular shape 94 at ground surface 56 at the anterior side 106 in housing 36. Rectangular shape 94 ridgeline 90 defines a ship position of spring plate contact 74 in the housing 34. The two small posts 180 at the anterior side 106 of housing 34 at ground surface 56 fits beneath the two bent ramps 182 of spring plate contact 74 in ship position (see FIG. 6*a*).

After assembly of spring plate contact 74 in housing 34, trigger 36 fits inside anterior side 106 of housing 34 across the spring plate contact 74. The tabs 38 of the trigger 36 are in the posterior position in housing 34. Alignment is in 44 is in sleeve 46 and the spacer 60 is in notch 70 of trigger 36. The three tabs 38 are just opposite grips 42 in housing 34. Cap 14 of container 10 is then is in an open position (FIG. 6*a* and FIG. 6*b*). The assembled cap 14 can be removed from receptacle 12.

To close cap 14 on receptacle 12, connect the bayonet connection shapes between grips 42 of housing 34 and grips 186 of receptacle 12. By this relative rotation between receptacle 12 to cap 14, the front of the grip 188 rotates trigger 36 in housing 34. The rotation angle of cap 14 against receptacle 12 is fixed by the bayonet mechanism. The bayonet mechanism functions as a child resistance closure of cap 14 to receptacle 12.

To open cap 14, press cap 14 in the posterior direction 24 and then rotate it in the open direction 190. By this rotation the backsides 192 of grips 186 of receptacle 12 press tabs 38 of trigger 36 so trigger 36 makes an open rotation inside cap 14. By this open and close movement 184 and 190 of cap 14 against receptacle 12, cap 14 can mechanically "see" if it is open or closed from receptacle 12 because trigger 36 works as an interface between receptacle 12 and cap 14. When cap 14 is first assembled, the mechanism of trigger 36 and spring plate contact 74 inside are positioned in a "ship position". Batteries 158 are then disconnected from the electronic circuit of the timing device 16 to extend the warranty of batteries 158. The caps, such as 14, of medical containers, such as 10, may be delivered separate from container 10. A pharmacist can then fill receptacle 12 with medicine and close receptacle 12 with cap 14.

Then trigger 36 for the first time rotates inside cap 14 to rotate spring plate contact 74 inside cap 14.

Ridge 88 of trigger 36 then presses ramp 96 of spring plate contact 74 to rotate spring plate contact 74 in an activated position (FIG. 7*b*). The two pins 180 at the anterior inner ground surface 56 in housing 34 will enter the two holes 178 of spring plate contact 74, which is then fixed in that position, and contact fingers 172, 174 and 176 makes contact to the contact paths 168, 164 and 166 of posterior surface 86 of board 118 to connect to the electronic circuit of timing device 16, so the electronic system is activated with battery cells 158 connected in circuit. In the assembled cap 14, the spring plate contact 74 is between the posterior surface 86 of board 118 and the anterior surface 56 in housing 34. The longitudinal forces of the three contact fingers 172, 174 and 176 press spring plate contact 74 to the anterior surface side 56 in housing 34. Thus, when container 10 is opened, by rotating cap 14 against receptacle 12, trigger 36 rotates and spring contact plate 74 is in position to surface 56 in housing 36 (FIG. 8) so battery cells 158 remain connected for the remaining operational life of cap 14.

When cap 14 is in a closed position (FIG. 7*a* 7*b*), the three tabs 38 of trigger 36 are opposite grips 42 of housing 34. The position of FIG. 7*a* is not possible without receptacle 12 because that is a closed position of cap 14 not then on receptacle 12. It is not possible to fit receptacle 12 to cap 14 in this position. The grips 186 of receptacle 12 cannot fit inside the posterior side 78 of the housing 34. The only possibility is that cap 14 must be in an open position as seen in FIGS. 6*a* and 6*b*.

When cap 14 is placed on receptacle 12, the position of trigger 34 inside cap 14 is shown in FIG. 7*b*. Only contacts fingers 172 and 174 of spring plate contact 74 connect to contact paths 166 and 168 beneath the board surface 86. The other contact 176 of spring plate contact 74 does connect to board surface 86. In a closed position of cap 14 to receptacle 12, the connection between the two contact paths 166 and 168 are not connected. The break connection of contact 176 is effected by ramp 84 of trigger 36. Ramp 84 rotates with an open and closed rotation of cap 14 just below the board surface 86. The top anterior surface 192 of ramp 84 slides to the surface 86 beneath board 118. So in the open position of cap 14 trigger 36 assumes the position shown in FIG. 8. The contact lip 176 of spring plate contact 74 then has a free position so that it contacts contact point 164 beneath board 118. The spring plate contact 74 in FIG. 8 keeps the fixed activated position, by the two small posts 180 at the anterior ground surface 56 of housing 34 to fit inside the two holes 178 of the spring plate contact 74. This position does not change after the first closing of cap 14.

FIG. 10 shows timing device 16 in the anterior side 78 of housing 14. Board 118 of timing device 16 supports the posterior direction 24 on the spacers 58, 60 and 62. There are two main alignment pins 44 and 68 at the anterior surface 56 of housing 34 to position board 118 in position holes 124 and 126 to allow timing device 16 to assume only one position in anterior side 106 of housing 36. Timing device 16 is locked up in posterior direction 28 the top part 18. Before closing cap 14 with top part 18, silicon button 140 having cylindrical base 150 with a small carbon surface is in assembled position of cap 14 just above anterior surface 120 of board 118 above contact surface 194 at the surface of the board 118. When the top of button 140 is pressed, the carbon surface is forced to contacts 194 to make an electric connection for timing device 16 as seen in FIG. 14. Top part 18 has a number of functions. The boll-shaped ridge 102 at the outer wall 114 of trigger 36 fits in the groove 100 of wall 66 at the anterior side 106 of housing 34. It locks the timing device 16 inside the housing 34. The outer wall 114 of top part 18 presses surface 122 in posterior direction to the surface 120 of board 118 and locks button 140.

Plastic seal 196 seals receptacle 12 normally air and water tight at the posterior side 78 inside housing 36, behind grips 42 and 80 of housing 34 and behind grips 52 of tabs 38 of trigger 36. A spacer ring 198 is mounted in the center of surface section 200 to keep the seal 196 in an assembled position of container 10 under pressure against receptacle 12.

Button 140, visible on the anterior side 30 of the cap 14, can be used for adjusting the timing of sound and flash reminder of cap 14.

When cap 14 is still in a not activated position, the two batteries 158 are not connected to the circuit device 16. When button 140 on the topside 30 of cap 14 is pressed, activation will not occur until cap 14 is first placed on receptacle 12. Then pressing button 140 at the topside 30 of activated cap 14, turns LED 20 on the topside 30 on. Continuing to press button 140 longer than one second causes sound buzzer 156 of timing device 16 to give a beep and switch LED 20 off. Then timing device 16 begins counting time. If programmed, for example for "one time a day", 24 hours after pressing button 140, buzzer 156 produces alarm beeping signals and LED 20 flashing. First, beeping signals occur frequently, later less frequently. The beeping and flashing signals stop after half of the next setting time, in this case after 12 hours. This continues when cap 14 is not opened from receptacle 12. When cap 14 is open, the beeping and flashing stops. If cap 14 is not opened after 48 hours, cap 14 again resumes beeping and flashing again. If container 10 is open before cap 14 begins beeping and flashing, timing device 16 will not start with beeping and flashing. This beeping and flashing repeats every 24 hours after the time when button 140 has been pressed. When it is desired to change the alert time, the button 140 can be pressed to change the time. After the new time, timing device 16 will react directly after 24 hours with the changed alert time. This programming is useful for patients taking a medication once a day. When the patient is to take the enclosed medication for example 2, 3 and 4 times a day, timing device 16 may be programmed differently, and the timing alert will react after shorter periods.

Upon closing cap 14 on receptacle 12, timing device 16 produces a short beeping sound to inform the user that cap 14 has been reset. Upon placing cap 14 on receptacle 12 after the first time and not pressing button 140, LED 20 gives only a flash upon closing cap 14 that is not time restricted.

The duration of the total alarm time may also be set by programming timing device 16, depending on how much medication the patient will use. Timing device 16 may be programmed, for example, 1 month, or 3 months. When the time reaches the end of medication period, cap 14 gives upon closing of receptacle 12, three beeps by three days before the end, two beeps by two days before the end and one long beep by the last day of the medical period of that medical container 10. The beginning of this period occurs when button 140 is pressed for the first time.

There has been described novel apparatus and techniques for cap timing. It is evident that those skilled in the art may now make numerous uses in modifications of and departures from the specific apparatus and techniques herein disclosed. Therefore, the invention is to be construed as embracing each and every novel feature and novel combination of features present in or possessed by the apparatus and techniques herein disclosed and limited solely by the scope and spirit of the appended claims.

What is claimed is:

1. A cap attachable to a receptacle for co-acting therewith in enclosing medication and timing a predetermined interval for taking the medication defined by one timing schedule of a set of selectable timing schedules comprising, an electronic timing circuit in said cap constructed and arranged to provide an alarm signal designating a time for taking the medication at the expiration of a predetermined time interval defined by the timing schedule, a battery for furnishing power to said electronic timing circuit, a switch connected between said battery and said electronic timing circuit having an initial ship position preventing the flow of electrical energy from said battery to said electronic timing circuit and an on position allowing delivery of electrical power from said battery to said electronic timing circuit, said switch constructed and arranged to be initially in said ship position and switched to said on position when said cap is first attached to said receptacle to close said receptacle.

2. A cap in accordance with claim 1 and further including a set-reset switch constructed and arranged to reset said electronic timing circuit to begin the pre-determined time interval when said cap is placed on said receptacle and to disable the provision of an alarm signal when said cap is removed from said receptacle.

3. A cap in accordance with claim 1 including a trigger, a housing with near posterior ends and a top portion, said trigger having a plurality of legs constructed and arranged to selectively activate and deactivate said electronic timing circuit, a ring section perpendicular to said tabs, and a ramp parallel to said ring section, said housing having sleeves in which said tabs fit and grips above which said tabs are positioned, rotation of said trigger inside said housing moving said tabs in reset areas in the near posterior ends of said housing, said electronic timing circuit having a board section surface, said cap constructed and arranged so that rotational movement of said trigger allows said ramp to freely move beneath said board section surface.

4. A cap in accordance with claim 3 and further comprising, a cylindrical button in said top portion constructed and arranged to activate said timing circuit upon being pressed.

5. A cap in accordance with claim 1 having a spring contact plate rotatable so that when said trigger rotates for the first time inside said cap, said spring plate contact rotates into an activated position to activate said electronic timing circuit.

* * * * *